US012644642B2

(12) United States Patent
Yadav et al.

(10) Patent No.: US 12,644,642 B2
(45) Date of Patent: Jun. 2, 2026

(54) CONTROL SCHEME FOR BEVERAGE COOLERS OPTIMIZED FOR BEVERAGE QUALITY AND FAST PULLDOWN TIME

(71) Applicant: Phononic, Inc., Durham, NC (US)

(72) Inventors: Abhishek Yadav, Cary, NC (US); Jesse W. Edwards, Wake Forest, NC (US); Devon Newman, Salt Lake City, UT (US); Simbarashe Nyika, Durham, NC (US)

(73) Assignee: Phononic, Inc., Durham, NC (US)

( * ) Notice: Subject to any disclaimer, the term of this patent is extended or adjusted under 35 U.S.C. 154(b) by 0 days.

(21) Appl. No.: 17/861,796

(22) Filed: Jul. 11, 2022

(65) Prior Publication Data

US 2023/0009192 A1 Jan. 12, 2023

Related U.S. Application Data

(60) Provisional application No. 63/220,360, filed on Jul. 9, 2021.

(51) Int. Cl.
*F25D 31/00* (2006.01)
*F25D 11/00* (2006.01)

(52) U.S. Cl.
CPC ..... *F25D 31/006* (2013.01); *F25D 11/003* (2013.01); *F25D 2700/02* (2013.01); *F25D 2700/16* (2013.01)

(58) Field of Classification Search
CPC .. F25D 31/006; F25D 11/003; F25D 2700/02; F25D 2700/16; F25D 2400/30;
(Continued)

(56) References Cited

U.S. PATENT DOCUMENTS 3,774,406 A 11/1973 Reitblatt
5,572,873 A 11/1996 Lavigne et al.
(Continued)

FOREIGN PATENT DOCUMENTS

CA 3095760 A1 10/2019
CN 106467127 A 3/2017
(Continued)

OTHER PUBLICATIONS

Non-Final Office Action for U.S. Appl. No. 17/499,199, mailed Nov. 4, 2022, 12 pages.
(Continued)

*Primary Examiner* — Larry L Furdge
*Assistant Examiner* — Dario Antonio Deleon
(74) *Attorney, Agent, or Firm* — Withrow + Terranova, PLLC

(57) ABSTRACT

Systems and methods for an actively cooled container comprising: a power subsystem; an active cooling subsystem; and a control subsystem are provided. In some embodiments, the control subsystem is configured to: determine that additional cooling is needed; cause the active cooling subsystem to cool the actively cooled container below a lower limit; determine to end the additional cooling; and cause the active cooling subsystem to cool the actively cooled container at or above the lower limit. In this way, the best balance between a fast cooldown time and not damaging (e.g., through freezing) the product load (e.g., beverages), is achieved.

20 Claims, 2 Drawing Sheets

(58) Field of Classification Search
CPC .... F25D 31/007; F25D 2400/28; F25D 29/00; F25B 21/02
See application file for complete search history.

(56) References Cited

U.S. PATENT DOCUMENTS

| | | | | |
|---|---|---|---|---|
| 6,119,469 | A | 9/2000 | Elwood | |
| 6,729,144 | B1 | 5/2004 | Kupferman | |
| 9,144,180 | B2 | 9/2015 | Olsson et al. | |
| 9,581,362 | B2 | 2/2017 | Stanley et al. | |
| 9,593,871 | B2 | 3/2017 | Stanley et al. | |
| 10,458,683 | B2 | 10/2019 | Edwards et al. | |
| 2002/0197135 | A1 | 12/2002 | Arntzen et al. | |
| 2005/0061877 | A1 | 3/2005 | Stevens | |
| 2007/0119187 | A1 | 5/2007 | Kitchens et al. | |
| 2013/0291555 | A1 | 11/2013 | Edwards et al. | |
| 2015/0075184 | A1* | 3/2015 | Edwards et al. | F25B 21/02 62/3.2 |
| 2015/0330703 | A1 | 11/2015 | Satou et al. | |
| 2016/0150683 | A1 | 5/2016 | Sagerian et al. | |
| 2016/0377338 | A1 | 12/2016 | Tanaka et al. | |
| 2017/0184333 | A1 | 6/2017 | Lukasse | |
| 2017/0215620 | A1 | 8/2017 | Dade et al. | |
| 2017/0265687 | A1 | 9/2017 | Veltrop et al. | |
| 2017/0363349 | A1 | 12/2017 | McHale et al. | |
| 2018/0164034 | A1 | 6/2018 | Banks | |
| 2018/0274826 | A1* | 9/2018 | Kim et al. | F25B 21/04 |
| 2019/0003757 | A1 | 1/2019 | Miros et al. | |
| 2019/0044753 | A1 | 2/2019 | Neeld | |
| 2019/0218029 | A1 | 7/2019 | Petz et al. | |
| 2019/0263219 | A1 | 8/2019 | Spath | |
| 2019/0323756 | A1* | 10/2019 | Alexander et al. | F25B 21/02 |
| 2019/0364398 | A1 | 11/2019 | Castonzo | |
| 2020/0158414 | A1 | 5/2020 | Farlotti et al. | |
| 2020/0256593 | A1* | 8/2020 | Spath | F25D 19/00 |
| 2021/0199353 | A1 | 7/2021 | Edwards et al. | |
| 2021/0364217 | A1 | 11/2021 | Ahmed | |
| 2021/0387557 | A1 | 12/2021 | Himmelreich et al. | |
| 2022/0049885 | A1 | 2/2022 | Twohy | |
| 2022/0113068 | A1 | 4/2022 | Lewis et al. | |
| 2022/0121159 | A1 | 4/2022 | Baerentz | |
| 2023/0053089 | A1 | 2/2023 | Fosnight et al. | |

FOREIGN PATENT DOCUMENTS

| | | | | |
|---|---|---|---|---|
| CN | 107745885 | A | 3/2018 | |
| CN | 109478269 | A | 3/2019 | |
| CN | 112050541 | A | 12/2020 | |
| CN | 113915903 | A | 1/2022 | |
| CN | 114061361 | A | 2/2022 | |
| EP | 0495463 | A2 * | 7/1992 | F25D 29/003 |
| EP | 1564514 | A1 | 8/2005 | |
| EP | 2947029 | A1 | 11/2015 | |
| JP | S57167380 | A | 10/1982 | |
| JP | S63065266 | A | 3/1988 | |
| JP | H01310278 | A | 12/1989 | |
| JP | H03292862 | A | 12/1991 | |
| JP | H0611230 | A | 1/1994 | |
| JP | H1026456 | A | 1/1998 | |
| JP | 2002228323 | A | 8/2002 | |
| JP | 2005172394 | A | 6/2005 | |
| JP | 2005300060 | A | 10/2005 | |
| JP | 2007271091 | A | 10/2007 | |
| JP | 2013234800 | A | 11/2013 | |
| JP | 2016080244 | A | 5/2016 | |
| JP | 2018013265 | A | 1/2018 | |
| JP | 2018091501 | A | 6/2018 | |
| JP | 2018150116 | A | 9/2018 | |
| JP | 2019184092 | A | 10/2019 | |
| JP | 2020529577 | A | 10/2020 | |
| KR | 20070019232 | A | 2/2007 | |
| KR | 1020150022811 | A | 3/2015 | |
| WO | 8302832 | A1 | 8/1983 | |
| WO | 9946154 | A1 | 9/1999 | |
| WO | 0125701 | A1 | 4/2001 | |
| WO | 0238456 | A1 | 5/2002 | |
| WO | 02076850 | A1 | 10/2002 | |
| WO | 2005078366 | A1 | 8/2005 | |
| WO | 2012109194 | A1 | 8/2012 | |
| WO | 2016000750 | A1 | 1/2016 | |
| WO | 2019071112 | A1 | 4/2019 | |
| WO | 2021157110 | A1 | 8/2021 | |

OTHER PUBLICATIONS

International Search Report and Written Opinion for International Patent Application No. PCT/US2022/036675, mailed Oct. 17, 2022, 13 pages.
International Search Report and Written Opinion for International Patent Application No. PCT/US2022/043699, mailed Nov. 28, 2022, 18 pages.
Advisory Action, Applicant-Initiated Interview Summary, and AFCP 2.0 Decision for U.S. Appl. No. 17/135,420, mailed Jul. 14, 2023, 5 pages.
Non-Final Office Action and Applicant-Initiated Interview Summary for U.S. Appl. No. 17/135,420, mailed Aug. 17, 2023, 14 pages.
Advisory Action for U.S. Appl. No. 17/499,199, mailed Aug. 11, 2023, 4 pages.
Non-Final Office Action for U.S. Appl. No. 17/499,199, mailed Aug. 23, 2023, 20 pages.
Final Office Action for U.S. Appl. No. 17/135,420, mailed Feb. 21, 2023, 16 pages.
Final Office Action for U.S. Appl. No. 17/499,199, mailed Apr. 14, 2023, 17 pages.
International Search Report and Written Opinion for International Patent Application No. PCT/US2021/054515, mailed Feb. 1, 2022, 15 pages.
International Search Report and Written Opinion for International Patent Application No. PCT/US2020/067172, mailed Apr. 19, 2021, 13 pages.
Non-Final Office Action for U.S. Appl. No. 17/135,420, mailed Aug. 2, 2022, 14 pages.
Notice of Allowance for U.S. Appl. No. 17/135,420, mailed Apr. 30, 2024, 11 pages.
Second Office Action for Chinese Patent Application No. 202080092062.3, mailed Apr. 10, 2024, 17 pages.
Final Office Action for U.S. Appl. No. 17/499,199, mailed Apr. 17, 2024, 21 pages.
Final Office Action for U.S. Appl. No. 17/135,420, mailed Dec. 4, 2023, 12 pages.
First Office Action for Chinese Patent Application No. 202080092062.3, mailed Oct. 19, 2023, 11 pages.
Final Office Action for U.S. Appl. No. 17/499,199, mailed Dec. 1, 2023, 20 pages.
Notification to Grant for Chinese Patent Application No. 2020800092062.3, mailed Jul. 22, 2024, 4 pages.
Exmination Report for European Patent Application No. 20845734.1, mailed Sep. 6, 2024, 5 pages.
Office Action for Vietnamese Patent Application No. 1-2022-04701, mailed Jun. 25, 2024, 4 pages.
Final Office Action and Applicant-Initiated Interview Summary for U.S. Appl. No. 17/499,199, mailed Sep. 4, 2024, 20 pages.
International Search Report and Written Opinion for International Patent Application No. PCT/US2024/027549, mailed Aug. 28, 2024, 13 pages.
Examination Report for European Patent Application No. 22751536.8, mailed Apr. 23, 2026, 6 pages.
Search Report for Japanese Patent Application No. 2023-579746, dated Apr. 1, 2026, 27 pages.
Notice for Reasons for Refusal for Japanese Patent Application No. 2023-579746, proposed Apr. 7, 2026, 15 pages.

* cited by examiner

CONTROL SCHEME FOR BEVERAGE COOLERS OPTIMIZED FOR BEVERAGE QUALITY AND FAST PULLDOWN TIME

RELATED APPLICATIONS

This application claims the benefit of provisional patent application Ser. No. 63/220,360, filed Jul. 9, 2021, the disclosure of which is hereby incorporated herein by reference in its entirety.

FIELD OF THE DISCLOSURE

The present disclosure relates to systems and methods related to actively cooled containers.

BACKGROUND

Current methods for refrigerated product storage in grocery, supply chain, delivery, and other perishable cold chain applications are: Phase-change material (i.e. "ice" packs: Paraffin, water-ice, glycol, Dry-ice, etc.). When items are added to the refrigerated space, the heat needs to be removed from these items. Improved systems and methods for cooled product storage are needed.

SUMMARY

Systems and methods for an actively cooled container comprising: a power subsystem; an active cooling subsystem; and a control subsystem are provided. In some embodiments, the control subsystem is configured to: determine that additional cooling is needed; cause the active cooling subsystem to cool the actively cooled container below a lower limit; determine to end the additional cooling; and cause the active cooling subsystem to cool the actively cooled container at or above the lower limit. In this way, the best balance between a fast cooldown time and not damaging the product load (beverages), through freezing is achieved.

In some embodiments, determining that additional cooling is needed comprises determining that additional products have been added to the actively cooled container.

In some embodiments, causing the active cooling subsystem to cool the actively cooled container below the lower limit comprises causing the active cooling subsystem to cool the actively cooled container below zero Celsius.

In some embodiments, determining to end the additional cooling comprises determining that a door open event has occurred.

In some embodiments, determining to end the additional cooling comprises determining that a time out event has occurred.

In some embodiments, the length of the time out event is such that products in the actively cooled container are not spoiled.

In some embodiments, the length of the time out event is such that products in the actively cooled container are not frozen.

In some embodiments, the length of the time out event is based on an ambient temperature of the actively cooled container.

In some embodiments, the length of the time out event is longer if the ambient temperature of the actively cooled container is lower.

In some embodiments, the active cooling subsystem comprises one or more Thermoelectric Coolers A time-based (both real-time and elapsed time) control feedback scheme can be used to achieve the best balance between a fast cooldown time and not damaging the product load (beverages), through freezing. To accomplish this, the control system operating mode will not immediately transition from Pull-down (highQ) to a variable capacity (VarQ) or high efficiency steady-state (HighCOP) mode, but will instead enter a temporary, intermediate high-capacity transition mode (referred to herein as LTSoak), that allows the system to remain in a high-capacity mode at a temperature below the actual setpoint but at product temperatures within the allowable range of temperatures for the product. This mode operates for a sufficient time to allow for all of the loaded products to reach the desired temperature, while still protecting them from localized and/or global freezing. After the completion of the LTSoak mode, the control system will revert back to standard mode transitions until LTSoak is triggered again.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1:
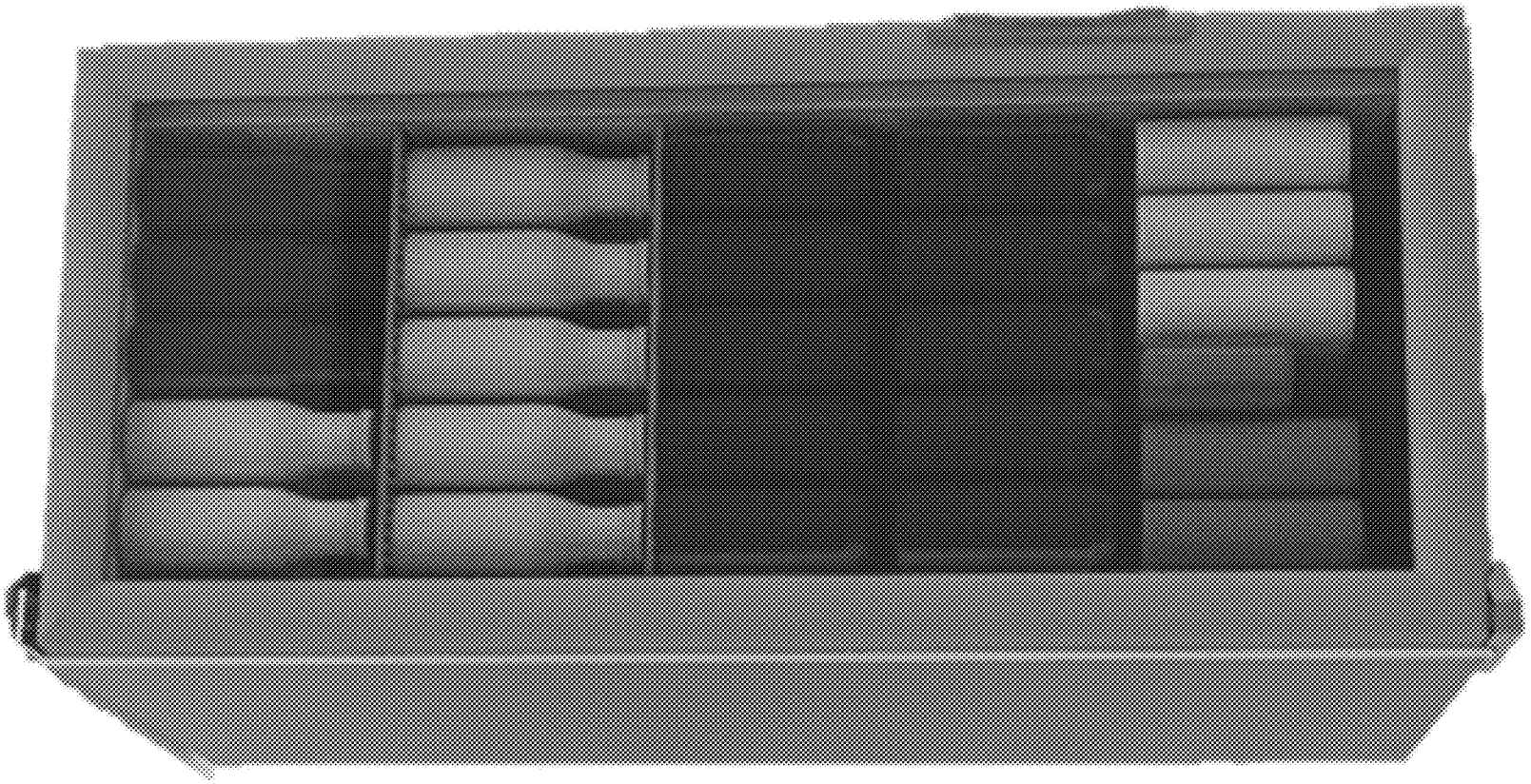
FIG. 1 illustrates an example of a refrigerator for storing beverages in which some embodiments can be employed.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Beverages are often chilled to temperatures between 1-4 C, which can lead to the product freezing if the refrigeration system temperatures are not controlled properly. Beverage sellers will often also desire a fast cool-down time ensure the best product experience as well as to maximize profits. During normal operation, particularly during high capacity pull-down (HighQ), the control device (thermometer, thermistor, thermocouple, RTD, etc.) will be colder than the average beverage temperature due to differences in thermal mass, and it will itself come to a steady-state temperature faster than the actual product being cooled. This conflict typically leads to longer real-world cool-down times for the beverages to both protect the product and allow for thermostatic control. If a simple temperature offset is used to compensate for the temperature difference between the control sensor and product load, then the temperature of the beverages risks going below freezing both locally and in bulk, and potentially damaging the product and/or making it unsellable.

A time-based (both real-time and elapsed time) control feedback scheme can be used to achieve the best balance between a fast cooldown time and not damaging the product load (beverages) through freezing. To accomplish this, the control system operating mode will not immediately transition from Pull-down (highQ) to a variable capacity (VarQ) or high efficiency steady-state (HighCOP) mode. Instead, it will enter a temporary, intermediate, high-capacity transition mode (referred to herein as LTSoak), that allows the system to remain in a high-capacity mode at a temperature below the actual setpoint but at product temperatures within the allowable range of temperatures for the product. This mode operates for a sufficient time to allow for all of the loaded products to reach the desired temperature, while still protecting them from localized and/or global freezing. After the completion of the LTSoak mode, the control system will revert back to standard mode transitions until LTSoak is triggered again.

A cooler (e.g., for food or other perishable item storage) with active thermoelectric cooling (TEC) to maintain internal temperature within cold chain or customer requirements is disclosed herein. This cooler with active TEC cooling is also referred to herein as an "active cooler". In some embodiments, the active cooler is used for storage and transportation of refrigerated and frozen food stuffs, medical or biological products, or the like. The active cooler maintains stable and uniform temperature control, powered via wall power, battery, or wireless power transmission.

FIG. 1 illustrates an example of a refrigerator for storing beverages in which some embodiments can be employed. Depicted is one operating example of a control system leveraging LTSoak. The present disclosure relates to an insulated container that features an active cooling system i.e., (thermoelectric, vapor-compression, Stirling, etc.) installed directly into the cooler in a removable or built-in module). FIG. 1 illustrates an example insulated container with active refrigeration system, according to some embodiments of the current disclosure. Additional details can be found in International Patent Application serial number PCT/US2020/067172, filed Dec. 28, 2020, the disclosure of which is hereby incorporated herein by reference in its entirety; and U.S. patent application Ser. No. 17/135,420, filed on Dec. 28, 2020, the disclosure of which is hereby incorporated herein by reference in its entirety. Both of these claim priority to Provisional Patent Application Ser. No. 62/953,771, filed Dec. 26, 2019.

In some embodiments, the control scheme includes one or more of the control schemes described in U.S. Patent Application Publication 2013/0291555, U.S. Patent Application Publication 2015/0075184, U.S. Pat. Nos. 9,581,362, 10,458,683, and 9,593,871, which are in incorporated herein by reference. In some embodiments, a thermal module includes a heat pump such as that described in U.S. Pat. No. 9,144,180, which is incorporated herein by reference. For heat extraction (i.e., heat accept) and heat rejection, the thermal module may include, for example, a heat accept system (e.g., thermosiphons or other passive or active heat exchange component(s) for transferring heat from an interior of the active cooler to a cold side of the TEC/heat pump) and a heat reject system (e.g., thermosiphons or other active or passive heat exchange components for transferring heat from a hot side of the TEC/heat pump to the ambient environment).

Figure 2:
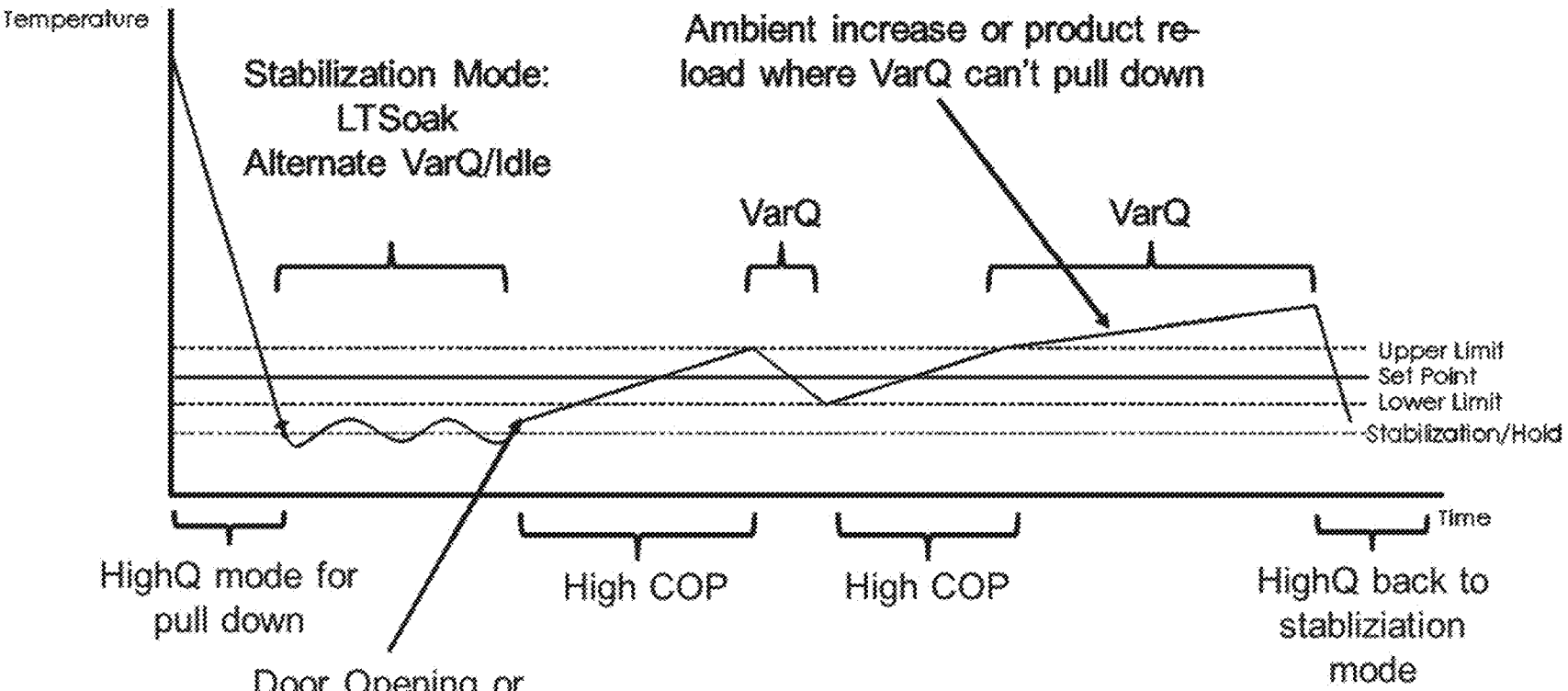
FIG. 2 illustrates an example of the operation of a cooling system according to some embodiments of the current disclosure.

FIG. 2 illustrates an example of the operation of a cooling system according to some embodiments of the current disclosure. When the refrigeration cabinet has been loaded or reloaded with warm beverages and is in a high-capacity pulldown mode (HighQ), then the control system will no longer transition directly to a standard variable capacity (VarQ) or steady-state high efficiency, temperature seek (HighCOP), but instead, it will transition into a reduced temperature, high capacity soak (LTSoak) mode after reaching and then passing the standard setpoint threshold for transition into VarQ or HighCOP mode. In some embodiments, if the ambient temp is very cold, this moves even faster. If ambient is lower, the system can stay in LTSoak longer. The heat pumping power, in LTSoak mode, may be kept constant as in HighQ mode or may be varied as in VarQ mode to allow the control system to seek a target temperature sensor offset, below the actual setpoint. The duration of the LTSoak transition mode may be fixed or variable and may be determined by, among other things, a simple timeout, the ambient temperature and amount of beverage which was loaded in the unit or through analysis of the rate of temperature change of the entire system.

Operating in the LTSoak mode instead of HighCOP or VarQ mode will allow the beverages within the refrigerator cabinet to continue to cool at a higher rate than they would otherwise be able to by continuing to operate the refrigeration system in a high-capacity heat removal mode for an extended period instead of throttling the system in lower capacity modes. This will allow the remaining products not at the desired setpoint temperature when the control sensor reaches the target temperature to cool faster to the desired set point before switching the refrigeration system control mode to a variable capacity (VarQ) or high efficiency steady-state seek (HighCOP) mode, which provides maximized efficiency and minimized energy consumption Those skilled in the art will recognize improvements and modifications to the preferred embodiments of the present disclosure. All such improvements and modifications are considered within the scope of the concepts disclosed herein and the claims that follow.

What is claimed is:

1. An actively cooled container comprising:
a power subsystem;
an active cooling subsystem; and
a control subsystem;
wherein the control subsystem is configured to:
operate the active cooling subsystem in a standard cooling mode to maintain the actively cooled container at a target setpoint;
determine that additional cooling is needed;
in response, cause the active cooling subsystem to cool the actively cooled container below a lower limit, wherein the lower limit is below the target setpoint;
determine to end the additional cooling;
in response, cause the active cooling subsystem to return to the standard cooling mode and cool the actively cooled container at or above the target setpoint.

2. The actively cooled container of claim 1 wherein being configured to determine that the additional cooling is needed comprises being configured to determine that additional products have been added to the actively cooled container.

3. The actively cooled container of claim 2 wherein being configured to cause the active cooling subsystem to cool the actively cooled container below the lower limit comprises being configured to cause the active cooling subsystem to cool the actively cooled container below zero Celsius.

4. The actively cooled container of claim 3 wherein being configured to determine to end the additional cooling comprises being configured to determine that a door open event has occurred.

5. The actively cooled container of claim 4 wherein being configured to determine to end the additional cooling comprises being configured to determine that a time out event has occurred.

6. The actively cooled container of claim 5 wherein the length of the time out event is such that products in the actively cooled container are not spoiled.

7. The actively cooled container of claim 6 wherein the length of the time out event is such that products in the actively cooled container are not frozen.

8. The actively cooled container of claim 7 wherein the length of the time out event is based on an ambient temperature of the actively cooled container.

9. The actively cooled container of claim 8 wherein the length of the time out event is longer if the ambient temperature of the actively cooled container is lower.

10. The actively cooled container of claim 9 wherein the active cooling subsystem comprises one or more Thermoelectric Coolers.

11. A method of controlling an actively cooled container comprising:

operating the active cooling subsystem in a standard cooling mode to maintain the actively cooled container at a target setpoint;

determining that additional cooling is needed;

in response, causing an active cooling subsystem to cool the actively cooled container below a lower limit, wherein the lower limit is below the target setpoint;

determining to end the additional cooling;

in response, causing the active cooling subsystem to return to the standard cooling mode and cool the actively cooled container at or above the target setpoint.

12. The method of claim 11 wherein determining that the additional cooling is needed comprises determining that additional products have been added to the actively cooled container.

13. The method of claim 12 wherein causing the active cooling subsystem to cool the actively cooled container below the lower limit comprises causing the active cooling subsystem to cool the actively cooled container below zero Celsius.

14. The method of claim 13 wherein determining to end the additional cooling comprises determining that a door open event has occurred.

15. The method of claim 14 wherein determining to end the additional cooling comprises determining that a time out event has occurred.

16. The method of claim 15 wherein the length of the time out event is such that products in the actively cooled container are not spoiled.

17. The method of claim 16 wherein the length of the time out event is such that products in the actively cooled container are not frozen.

18. The method of claim 17 wherein the length of the time out event is based on an ambient temperature of the actively cooled container.

19. The method of claim 18 wherein the length of the time out event is longer if the ambient temperature of the actively cooled container is lower.

20. The method of claim 19 wherein the active cooling subsystem comprises one or more Thermoelectric Coolers.

* * * * *